United States Patent [19]

Schlecht

[11] Patent Number: 4,900,191

[45] Date of Patent: Feb. 13, 1990

[54] METHOD FOR REMOVAL OF BROKEN GROUND

[76] Inventor: Karl Schlecht, Blumhardtstrasse 9, 7000 Stuttgart 70, Fed. Rep. of Germany

[21] Appl. No.: 138,560

[22] Filed: Dec. 24, 1987

[30] Foreign Application Priority Data

Dec. 31, 1986 [DE] Fed. Rep. of Germany ..... 3644818

[51] Int. Cl.[4] ..... E02D 29/00; E21D 9/12

[52] U.S. Cl. ..... 405/138; 405/267; 405/137

[58] Field of Search ..... 405/132, 136, 137, 138, 405/144, 267; 299/2, 18

[56] References Cited

U.S. PATENT DOCUMENTS

| | | | |
|---|---|---|---|
| 2,233,872 | 3/1941 | Proctor | 405/266 |
| 3,334,945 | 8/1967 | Bartlett | 405/144 X |
| 3,386,251 | 6/1968 | Casagrande et al. | 405/258 |
| 3,616,855 | 11/1971 | Colgate | 166/283 |
| 4,101,333 | 7/1978 | Wayment | 405/267 X |
| 4,370,077 | 1/1983 | Colgate | 405/266 X |
| 4,666,346 | 5/1987 | MacLeod | 405/267 X |

FOREIGN PATENT DOCUMENTS

| | | | |
|---|---|---|---|
| 2644319 | 4/1978 | Fed. Rep. of Germany . | |
| 3125644 | 1/1983 | Fed. Rep. of Germany . | |
| 1083322 | 9/1967 | United Kingdom | 405/144 X |
| 2117817 | 10/1983 | United Kingdom . | |

*Primary Examiner*—Randolph A. Reese
*Assistant Examiner*—Arlen L. Olsen
*Attorney, Agent, or Firm*—Horst M. Kasper

[57] ABSTRACT

In order to avoid the time-consuming transport by road or rail vehicles, in many cases, overburden is pumped to the outside of a tunnel under construction, where it is dumped onto dump-hills. In order to avoid such dump-hills as well as extended transport distances, according to the invention it is disclosed that the overburden is transported, dumped or stored, via channels drilled into the wall of the tunnel, inside of the mountain surrounding the tunnel, and also to transport the overburden, in case of a tunnel to be constructed under a waterway, by means of a pipe into the waterway or to the surface of the waterway.

13 Claims, 2 Drawing Sheets ca. 2000 m
30 80 m
50 100 m
1
2
3
10
12
14
16
20
22
24
26
28
30
32
36
38
40
42
44
46
48
50

METHOD FOR REMOVAL OF BROKEN GROUND

BACKGROUND OF THE INVENTION

1. Field of the Invention

The present invention relates to a method for the removal and elimination of broken ground in the construction of tunnels, where the resulting broken ground is pumped out of the tunnel.

2. Brief Description of the Background of the Invention Including Prior Art

The removal of broken ground with vehicles has in many cases been proven to be disadvantageous because of the time-consuming loading of conveyor and transport equipment and the danger associated with it of dust formation. In particular, the gravel or shotter generates difficulties, where broken ground cannot be carried and transported away on a haulage level.

German Patent Application Laid Open DE-OS 3,135,644 teaches to haul the broken ground occurring during tunnel construction with the aid of a pump out of the tunnel. The removal and transporting of the broken ground in a pump procedure can, on the other hand, not be performed over arbitrary long distances based on economic considerations. Furthermore, in such a case, the broken ground initially dumped outside of the tunnel on waste dumps has to be loaded onto motor vehicles and transported away.

SUMMARY OF THE INVENTION

1. Purposes of the Invention

It is an object of the invention to provide a method which allows the construction of very long tunnels, in particular in the context of placing tunnels under waterways or watercourses, under sea inlets, and the like.

It is another object of the invention to provide a method of disposing of broken ground and of bottom rock in tunnel construction in an economic way and without changes the landscape surrounding the tunnel.

These and other objects and advantages of the present invention will become evident from the description which follows.

2. Brief Description of the Invention

The present invention provides for a method for the disposal of broken ground in the construction of tunnels. The excavating of a tunnel generates overburden. A channel is construction which penetrates a tunnel wall in a substantially radial direction into an earth region close to the tunnel. The generated broken ground is pumped under pressure in order to transport it through said channel.

A liquid can be added to the broken ground. The liquid and the broken ground can be mixed for obtaining a mixture of liquid and broken ground in a paste-like state. The mixture of liquid and overburden is placed into the suction region of a pump.

Preferably, at least one channel is drilled from the tunnel into the neighboring earth soil surface and the broken ground is transported away through said channel. The broken ground can be pumped through at least one steel pipe placed into the channel. The channel can be disposed substantially vertical. The broken ground can be transported via said substantially vertical channel into a waterway disposed above the tunnel.

The broken ground can be transported to the surface of a water course through a pipe disposed above the tunnel and extending to an area near the surface of the water course. The broken ground can be transported into a dry rock region located under the earth's surface. The channel, destined for the transport of the broken ground, can be drilled from the tunnel into the surrounding rock formation region in a substantially horizontal direction.

A pressure can be exerted on the broken ground to be transported corresponding to at least the earth's pressure at the exit location of the channel. The broken ground can be pushed into the rock formation region below the earth's surface under exertion of deformation and/or displacement work.

An aqueous liquid, with a pressure exceeding the earth's pressure, can be pumped into the rock region under exertion of deformation and displacement work. Subsequently, the broken ground can be hauled into the same area.

The pocket in the underground can be formed under the effect of the pressure of the broken ground and the said pocket can the be filled with the broken ground.

The tunnel wall can be reinforced in a region for balancing a pressure generated by broken ground and for stiffening the tunnel wall from the tunnel. The broken ground can be pumped through the channel in the tunnel wall into an immediate neighborhood of the tunnel.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention.

DESCRIPTION OF INVENTION AND PREFERRED EMBODIMENT

Figure 1:
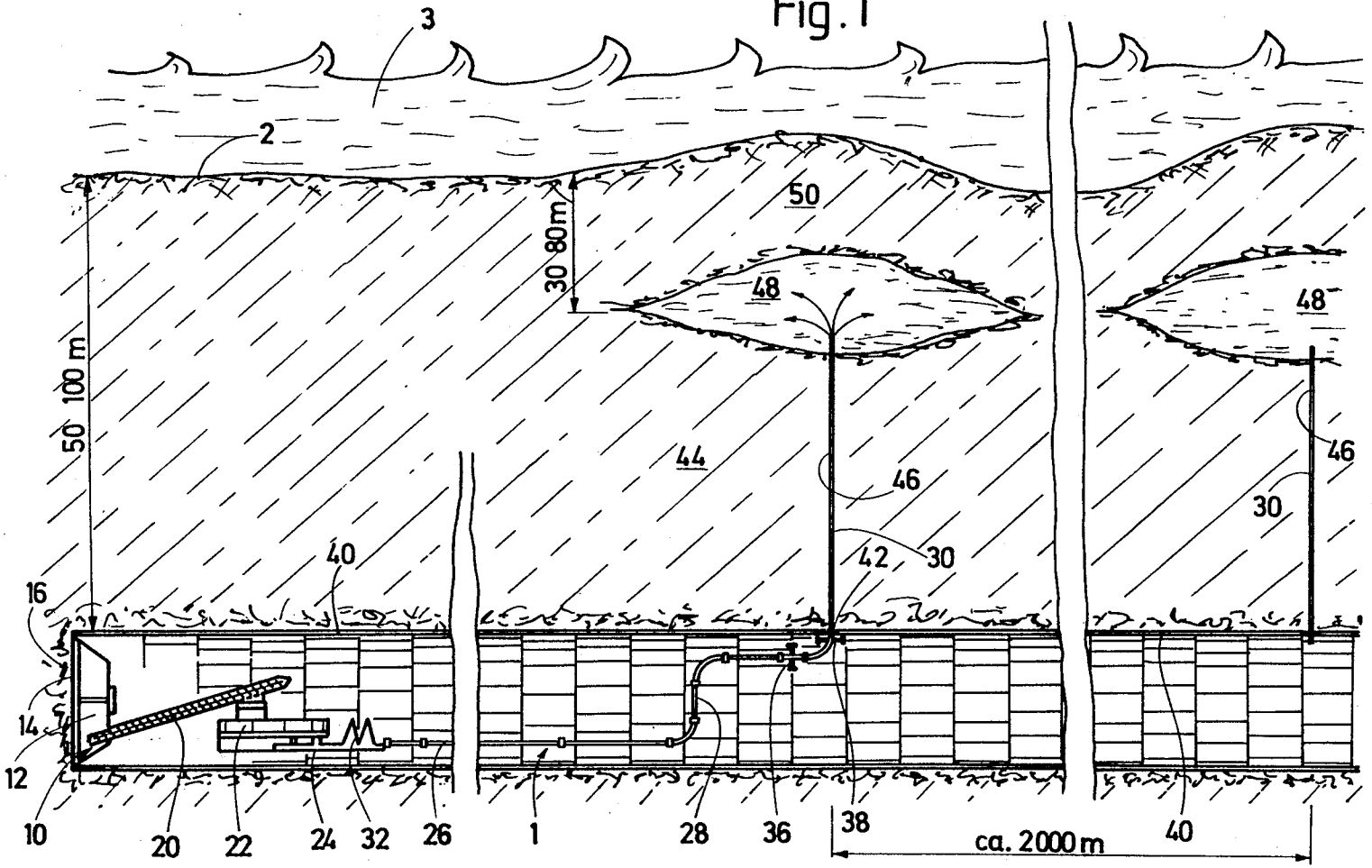
FIG. 1 is a sectional view through an underwater tunnel construction with broken ground elimination into the earth.

In accordance with the invention, there is provided a method for the disposal of broken ground in the construction of tunnels. The generated broken ground is pumped away and is transported under pressure through a channel penetrating substantially in a radial direction the tunnel wall under pressure into a region close to the tunnel.

The excavated broken ground can be placed into the suction region of a pump by addition of a liquid, such as water, mixed into a paste-like state. The broken ground can be transported away through at least one channel drilled from the channel into the neighboring earth soil surface.

The broken ground can be transported via a substantially vertical channel into a waterway disposed above the tunnel, such as, for example, the sea floor. The broken ground can transported to the surface of a water course through a pipe disposed above the tunnel and extending to an area near the surface of the waterway.

The broken ground can be transported into a preferably dry rock region located under the earth's surface.

Preferably, the channel, destined for the transport of the broken ground, is drilled from the tunnel, in a substantially horizontal direction, into the surrounding rock formation region. The broken ground can be transported, under exertion of a pressure corresponding to at least the earth's pressure at the exit location of the channel, under exertion of deformation and/or displacement work, into the rock formation region below the earth's surface rock formation region.

A liquid, preferably water, can be pumped with a pressure exceeding the earth's pressure, under exertion of deformation and displacement work, into the rock region and the broken ground can be subsequently hauled into the same area.

The pocket in the underground can be formed under the effect of the pressure of the overburden and said pocket can then be filled with the broken ground. The broken ground can be pumped through at least one pipe, preferably made of steel, placed into the channel.

The broken ground can be pumped through the radial bore in the tunnel wall into an immediate neighborhood of the tunnel. The tunnel wall can be temporarily or permanently reinforced in the corresponding region for accepting the broken ground pressure, or the tunnel wall can be stiffened from its inside.

In accordance with the invention, it is considered that only relatively short hauling distances have to be overcome for the elimination and disposal of the overburden in the haulage of the broken ground through a drilling bore radially penetrating the tunnel wall, and possibly at least one channel drilled into the earth surrounding the tunnel. Advantageously, for this purpose, mud pumps, sludge pumps, slurry pumps, thick-matter pumps are employed to haul, under pressure, the overburden, which has been mixed with a liquid, such as water, to a paste-like, pumpable paste or slurry, from the place of generation to a disposal site. If the pump pressure line ends under the earth's surface, then, in case of increasing hauling, an expanding lenticular region is generated filled with broken ground. In this case, the broken ground has to be hauled into the earth under application of a pressure corresponding to at least the earth pressure at the exit point of the channel or, respectively, at the pump-pressure line, under exertion of a deformation and/or displacement work or energy.

According to experience, in case of broken ground channels opening or discharging under the earth's surface, it is sufficient to exert initially at least a fluid pressure corresponding to the earth's pressure in order to generate cracks or fissures and hollow spaces or cavities, into which the broken ground can then be transported under pressure and under additional deformation and lifting of the earth.

In case of tunnels, where the ceiling is running only slightly below of a watercourse, the broken ground channels are preferably run horizontally out of the tunnel. In this manner, the broken ground is transported into areas from where no pressure is exerted onto the tunnel wall and from which the broken ground cannot flow back or, respectively, where a flowing back can be easily prevented. Advantageously, the channel runs into a dry rock region, because this alleviates the placing of the borehole and avoids a water incursion from the body of water disposed above.

In order to avoid, that the broken ground pressure acts onto the newly constructed tunnel pipe, possibly crushing this tunnel pipe, it is disclosed according to the invention that, at least the first part of the channel bore, following the tunnel pipe, be provided with an inner jacket of steel pipes. In addition, it is thereby achieved that the bore cannot collapse upon the pulling out of the drill, which drilled the channel. In principle, it is even possible to pump the broken ground through the radial bore into the immediate neighborhood of the tunnel, if care is taken that the tunnel wall is reinforced and stiffened temporarily or permanently such that the pressure generated by the broken ground can be accepted.

In case of an underwater or submarine tunnel, the transporting and haulage channel can also be raised up to the floor of the body of water in order to transport the broken ground to the floor of the body of water, for example, the sea floor. In principle, it is possible to haul the broken ground through a pipe extending to the surface of the water above the tunnel. The broken ground can be loaded from this pipe onto ships and water vehicles and the broken ground can be transported away with these vehicles.

Figure 2:
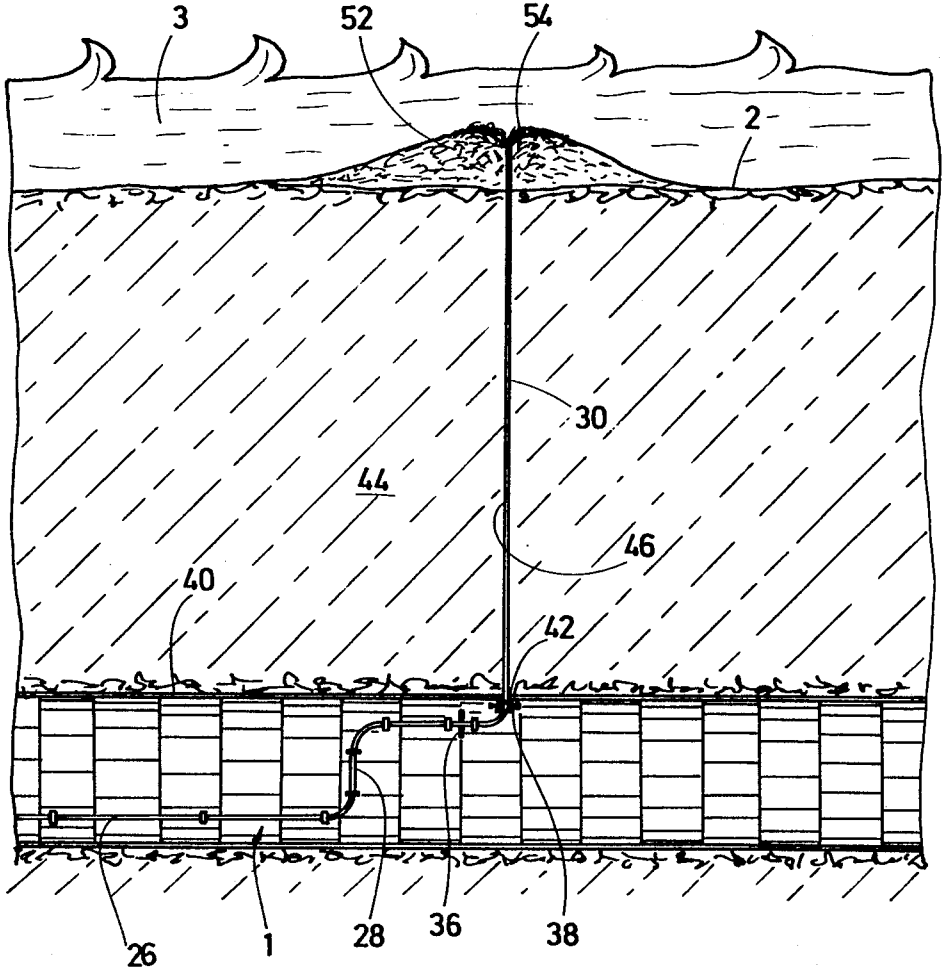
FIG. 2 is a section view through an underwater tunnel construction with broken ground elimination to the floor of the body of water.

The construction of the tunnel 1 shown in FIGS. 1 and 2 is driven about 50 to 100 meters under the ground 2 of a body of water 3, for example under the sea floor. The tunnelling work is performed with the aid of a closed tunnelling machine 10. The milled out broken ground is caught in the inner space 12, which broken ground was milled by the mining tool 14 from the forefield or front of the tunnel 1 and is fed via a worm conveyor 20 to a mixing container 22 for an intensive mixing with water. The resultant granular paste-like broken ground mass passes to a high-pressure mud pump 24, which transports the broken ground mass under pressure into a pipeline 26, 28, 30. The pipeline connected via a scissor pipe 32 to the mud pump 24 is placed in a first section 26 for a section along the already finished tunnel 1. The pipeline is passed via a short curved section 28, in the region of which there are disposed two gate valves 36, 38, through a bore 42 passing perpendicular to the tunnel wall 40 at the end of this section 26, which can be up to 2000 meters long. Then there follows a further pipe line section 30 which passes through a bore channel 46 placed into the earth 44 close to the tunnel.

The bore channel 46 ends with the pipe line section 30 within the earth 44 according to the embodiment illustrated in FIG. 1, while, according to the embodiment of FIG. 2, the bore channel 46 reaches up to the floor of the body of water.

If the paste-like broken ground is pumped under a pressure of at least about 30 bar and preferably from about 50 to 80 bar through the pipe line 26, 28, 30, then according to the method illustrated in FIG. 1, a slowly increasing lenticular space 48 filled with broken ground in the earth 44, while the earth masses 50 disposed above are raised correspondingly.

In the case of the method according to FIG. 2, the broken ground mass expands under formation of a crater-shaped waste bank 52 on the floor 2 of the body of water around the exit point 54 of the pipeline section 30. In case of a longer tunnel 1, additional bore channels 46 are placed for the broken ground elimination perpendicularly through the tunnel wall 40 into the earth 44, depending on the conditions in the course of the tunnelling in the surrounding earth 44 at distances of from about 500 to 2000 meters. After termination of the broken ground elimination, the bore channels 46 and the pipeline sections 30 disposed therein, as well as the bores 42 in the tunnel wall are permanently closed and sealed with cement or concrete. The pipelines can have a diameter of from 0.1 to 1.0 meter and preferably of from 0.2 to 0.5 meter.

The bore channels 46 do not necessarily have to be perpendicular to the earth's surface or perpendicular to the tunnel wall as this has been illustrated for simplicity's and clarity's sake in FIGS. 1 and 2. It is possible to provide bore channels at an angle or in a horizontal position through the earth 44. It is advantageous if such a drilling direction is selected where, in a region as close as possible to the tunnel, there are dry rock strata, which are suitable for receiving the broken ground without creating the danger of a water incursion occurrence.

It will be understood that each of the elements described above, or two or more together, may also find a useful application in other types disposal or removal systems differing from the types described above.

While the invention has been illustrated and described as embodied in the context of a method for removal of broken ground, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A method for the disposal of broken ground in the construction of tunnels comprising excavating a tunnel and thereby generating broken ground;

constructing at least one channel penetrating a tunnel wall in a substantially radial direction and extending to an area under the earth's surface; and pumping generated broken ground under pressure for transporting the broken ground through said channel.

2. The method according to claim 1, further comprising adding a liquid to the broken ground;

mixing the liquid and the broken ground for obtaining a mixture of liquid and broken ground in a paste-like state;

placing the mixture of liquid and broken ground into the suction region of a pump.

3. The method according to claim 2 further comprising drilling the at least one channel from the tunnel into the neighboring earth soil surface; and transporting the broken ground away through at least said channel.

4. The method according to claim 3 further comprising pumping the broken ground through at least one steel pipe placed into the at least one channel.

5. The method according to claim 1 further comprising reinforcing the tunnel wall in a region of the channel for balancing a pressure generated by broken ground and for stiffening the tunnel wall; and pumping the broken ground through the channel in the tunnel wall into an immediate neighborhood of the tunnel.

6. A method for the disposal of broken ground in the construction of tunnels comprising excavating a tunnel and thereby generating broken ground;

constructing a channel penetrating a tunnel wall in a substantially radial direction into an earth region close to the tunnel;

pumping generated broken ground under pressure for transporting the broken ground through said channel;

transporting the broken ground into a dry rock region located under the earth's surface.

7. The method according to claim 6, further comprising drilling the channel, destined for the transport of the broken ground, from the tunnel into the surrounding rock formation region in a substantially horizontal direction.

8. The method according to claim 6 further comprising exerting a pressure on the broken ground to be transported corresponding to at least the earth's pressure at the exit location of the channel;

pushing the broken ground into the rock formation region below the earth's surface under exertion of deformation and/or displacement work.

9. The method according to claim 6 wherein said pumping and transporting further comprises pumping an aqueous liquid with a pressure exceeding the earth's pressure, into the rock region under exertion of deformation and displacement work; and hauling the broken ground subsequently into the same area.

10. The method according to claim 6 further comprising forming a pocket in an area under the earth's surface under the effect of the pressure of the broken ground; and filling said pocket then with the broken ground.

11. A method for the disposal of broken ground in the construction of tunnels comprising excavating a tunnel and thereby generating broken ground;

pumping generated broken ground under pressure through at least one channel penetrating substantially in a radial direction the tunnel wall into a region close to the tunnel located under the earth's surface.

12. The method according to claim 11 further comprising placing the broken ground into the suction region of a pump by addition of a liquid, such as water, into a paste-like state; and transporting the broken ground away through said at least one channel drilled from the tunnel bore into an area under the earth's surface.

13. A method for the disposal of broken ground in the construction of tunnels comprising excavating a tunnel and thereby generating broken ground and constructing a tunnel wall;

drilling at least one bore radially penetrating the preconstructed tunnel wall;

drilling at least one channel into an area under the earth's surface close to the tunnel, which channel is destined for a transport of the broken ground, from the tunnel into the surrounding rock formation region in a substantially horizontal direction;

pumping an aqueous liquid with a pressure exceeding the earth's pressure into a dry rock region located under the earth's surface under exertion of deformation and displacement work;

hauling the broken ground subsequently into the same area by pumping generated broken ground under pressure for transporting the broken ground through said tunnel wall bore and said channel;

exerting a pressure on the broken ground to be transported corresponding to at least the earth's pressure at the exit location of the channel;

pushing the broken ground into the rock formation region below the earth's surface under exertion of deformation and/or displacement work; and forming the pocket in the underground under the effect of the pressure of the broken ground; and filling said pocket then with the broken ground;

permanently closing and sealing said channel and said tunnel wall bore after termination of broken ground disposal.

* * * * *